United States Patent [19]

Habib

[11] 4,064,657

[45] Dec. 27, 1977

[54] MACHINE FOR MACHINING SPIRAL CUTTING EDGES ON CUTTING TOOLS

[76] Inventor: Robert Habib, 36, Quai Gustave Ador, 1207 Geneva, Switzerland

[21] Appl. No.: 691,029

[22] Filed: May 28, 1976

[30] Foreign Application Priority Data

June 6, 1975 Switzerland ..... 7345/75

[51] Int. Cl.[2] ..... B24B 19/00

[52] U.S. Cl. ..... 51/33 W; 51/37; 51/48 HE; 51/219 R; 51/225; 90/11.5

[58] Field of Search ..... 51/48 HE, 95 R, 95 LH, 51/219 R, 225, 232, 32, 37; 90/11.5, DIG. 4, 33 W

[56] References Cited

U.S. PATENT DOCUMENTS

| | | | |
|---|---|---|---|
| 1,759,196 | 5/1930 | Jackson | 51/32 |
| 2,449,179 | 9/1948 | Scharping | 51/95 LH X |
| 2,574,111 | 11/1951 | Kopec | 51/232 |
| 3,623,277 | 11/1971 | Bottcher | 51/225 |
| 3,813,823 | 6/1974 | Southland | 51/225 X |
| 3,851,563 | 12/1974 | Habib | 51/48 HE X |

FOREIGN PATENT DOCUMENTS

| | | | |
|---|---|---|---|
| 248,512 | 10/1969 | U.S.S.R. | 51/225 |

*Primary Examiner*—Gary L. Smith

*Attorney, Agent, or Firm*—Robert E. Burns; Emmanuel J. Lobato; Bruce L. Adams

[57] ABSTRACT

A machine for machining a spiral cutting edge on an elongate workpiece having a rounded head by moving the workpiece relative to a rotating tool comprises a support unit mounted for vertical translational movement and rotation about a vertical axis. The support unit carries a headstock which can be positioned to make the axis of its workpiece-carrying spindle intersect the vertical axis, and a device for helicoidally driving the headstock spindle. The support unit rests on an inclined ramp surrounding the vertical axis and along which the unit can roll to helicoidally move the headstock for spirally machining a cutting edge into the rounded end of the workpiece. Thereafter a spiral cutting edge is machined into the cylindrical shaft of the workpiece, smoothly continuing the rounded, spiral edge.

7 Claims, 7 Drawing Figures

MACHINE FOR MACHINING SPIRAL CUTTING EDGES ON CUTTING TOOLS

BACKGROUND OF THE INVENTION

The invention concerns a machine of the type for machining a spiral cutting edge on a workpiece having an elongate shank with an at least partially rounded head by relatively moving the workpiece and a rotating machining tool, to produce a machined tool from the workpiece. The machine comprises a support unit having first and second supports mounted for sliding movement relative to one another in a horizontal plane and rotation together about a vertical axis; a headstock carried by the first support, the headstock having a spindle for carrying the workpiece to be machined, and being positionable so that the axis of the spindle intersects said vertical axis; and a device mounted on the second support for helicoidally driving the headstock spindle.

A known machine of this type, described in applicant's U.S. Pat. No. 3,851,563, comprises a carriage carrying a transverse slide on which is mounted a longitudinal slide by means of a support which is rotatable and inclinable on the transverse slide. The device for helicoidally driving the headstock spindle is fixed on the inclinable part of the support and includes a cursor moving along a stationary guide whose angular inclination can be set from 0° to 90° relative to the longitudinal slide. To machine a hemispherical end of a workpiece, the support of the longitudinal slide is inclined by an angle equal to the slope of a spiral to be cut on the cylindrical part of the workpiece, the centre of the sphere is brought onto the vertical axis of rotation, and then, after having brought the rotating machining tool (e.g. a grinding wheel) to the operating position, the support is turned by 90° about the vertical axis. This rotation produces a grinding along a circular arc, i.e. in a plane. Then the device for helicoidally driving the headstock spindle is started, and the ground circular arc is extended by a spiral, with a progressive unbroken joint between the two parts of the machined cutting edge. This machine, which provided a progress over the prior machines since it enabled a continuous machining capable of automation, nevertheless involves some drawbacks. Firstly, the mass that must be held inclined at a very precise inclination is great, and this requires a costly structure. Secondly, although the joint between the extremity of the circular arc (which in projection is rectilinear) and the spiral cutting edge is unbroken, this joint is in the form of an indefinite curve over a relatively short distance. Finally, on its rounded end, the machined tool (for example a spiral cutter) has a non-spiral cutting edge coplanar with the tool axis, and this may adversely effect the machining characteristics of the end of the tool.

An aim of the invention is to obviate these drawbacks.

SUMMARY OF THE INVENTION

According to the invention, a machine of the type defined above also comprises means for mounting the workpiece-carrying headstock on its support unit, and the machining tool, for vertical translational movement relative to one another, and means for simultaneously imparting (a) the relative vertical translational movement to the support unit and the machining tool and (b) a rotation of the support unit about said vertical axis to provide a helicoidal relative movement of the support unit and the machining tool.

In a preferred embodiment of the invention, the machine comprises a third support on which the support unit for the workpiece-carrying headstock is mounted for vertical translational movement and rotation about said vertical axis, said third support including means defining a ramp on which the support unit rests, said ramp imparting the vertical translational movement to the support unit and during the rotation thereof about said vertical axis.

The helicoidal or helical relative movement may be along a helix of variable pitch, or a helix of constant pitch, according to whether the support unit (or carrier of the machining tool) moves vertically by bearing on a plane inclined to the vertical axis or on a helicoidal ramp of constant slope, such as a screw.

The machine according to the invention can be used for machining, in a single pass starting from the rounded end of the workpiece, a spiral cutting edge extending along the machined tool. In the case where the support unit bears during its rotation on an inclined plane, by inclining this plane at an angle corresponding to the slope of the spiral to be machined it is possible to provide a perfect joint between the helix generated by rotation of the support unit about the vertical axis and that generated by the device for helicoidally driving the headstock spindle. When the slope of the ramp is relatively great, the gemetrical incompatibility between a spherical surface and a cylindrical spiral becomes appreciable. To compensate for this, the centre of the sphere (defined by the hemispherical curved end part of the machined tool constituting the workpiece) can be displaced relative to the vertical axis of rotation before machining.

BRIEF DESCRIPTION OF THE DRAWING

The accompanying drawings show, schematically and by way of example, an embodiment of the invention.

DESCRIPTION OF THE PREFERRED EMBODIMENT

Figure 1:
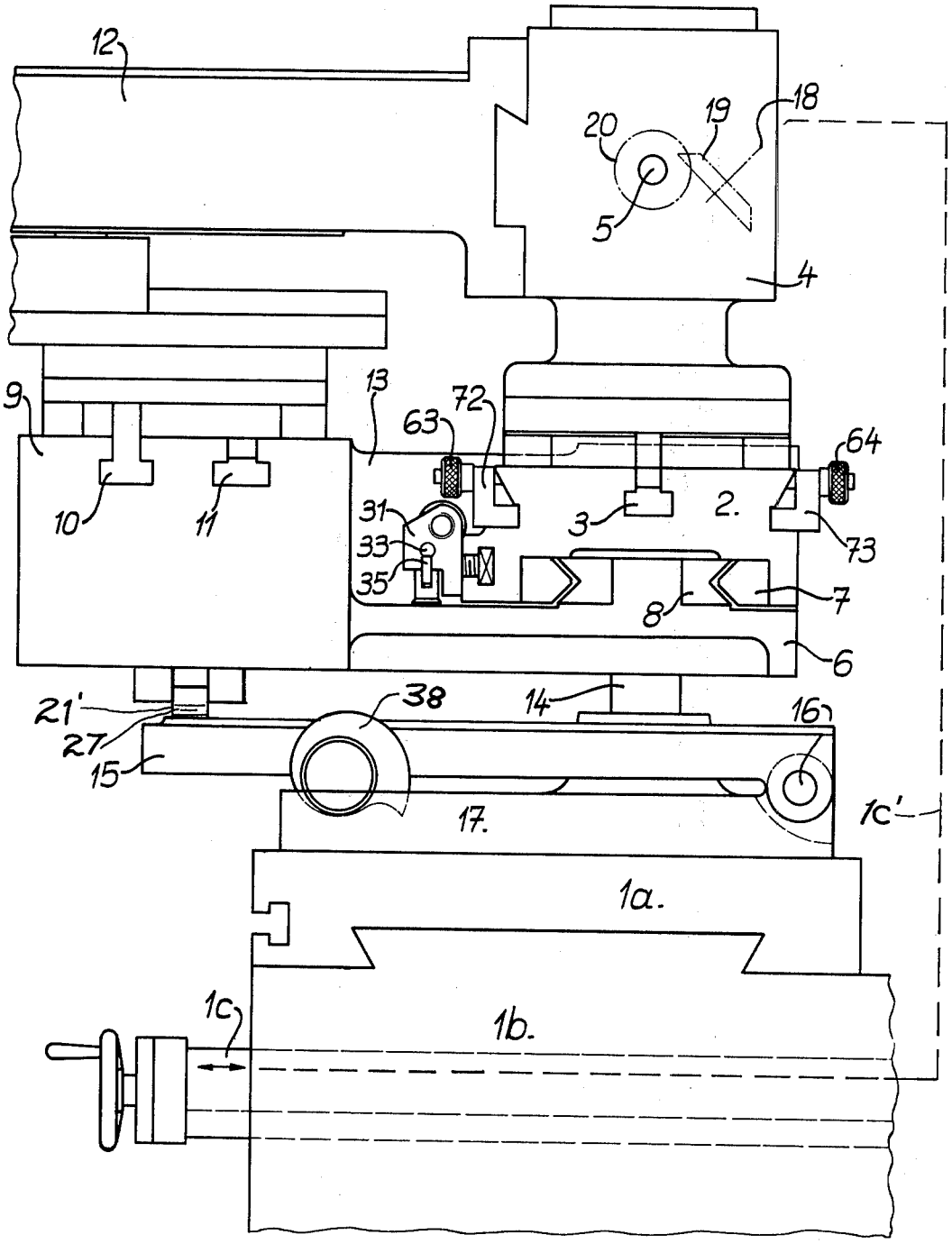
FIG. 1 is a schematic elevational view of the machine with some parts removed.

The machine shown in FIG. 1 comprises the components of applicant's previous machines, well known to persons skilled in the art, and not shown in detail, including a longitudinal slide 1*a* mounted for sliding in a direction, perpendicular to the plane of FIG. 1, on a piece 1*b* fixed to or as shown integral with the frame of the machine; a transverse slide 1*c*, also directly mounted on the frame, under the slide 1*a*, passing through piece 1*b* and slidable in a direction parallel to the plane of FIG. 1; and, on slide 1*c* a column carrying a grinding wheel carrier, as schematically indicated by broken line 1*c'*, a grinding wheel carrier (3) of the indicated type being fully described in U.S. Pat. No. 3,851,563. Only the axis 18 of this carrier is shown, carrying a grinding wheel 19 in a position for grinding a workpiece 20 to form a hemispherically-ended, helicoidally-toothed milling cutter. The two slides 1*a*, 1*c* enable the positions of the grinding wheel 19 and of the workpiece 20 to be set relative to one another, in a manner corresponding to the relative setting of grinding wheel 15 and workpiece 8 in the patent, although the exact details of the present machine are not identical with these of the patent. On the longitudinal slide 1*a* are mounted the principal components of the grinding machine, including a first support in the form of a table 2 having a longitudinal groove 3 of T-section for securing a headstock 4 including a rotary workpiece-supporting spindle 5 whose axis is perpendicular to the plane of FIG. 1. The headstock can for example be identical to headstock 7 described in U.S. Pat. No. 3,851,563. Table 2 is slidably mounted on a second support 6 by the intermediary of a well-known type of slide $\frac{7}{8}$ with needle bearings 6*a*, FIG. 2. The support 6 has a box-like lateral part 9 in which are machined two T-section grooves 10 and 11 for securing a device 12 for helicoidally driving the spindle 5 of headstock 4. Details of this device are not shown, as a device of this kind is described in U.S. Pat. No. 3,851,563 at 51,104 etc. Of course, other known devices of the same type (sometimes called "sine bars") could be used. The box-like lateral part 9 is connected by vertical ribs 13 to a horizontal plate 22 forming part of the second support 6 and which accordingly can be made very rigid while it is relatively light, also set FIG. 2.

In addition to its longitudinal movement along groove 3, the headstock 4 can also be slightly moved transversely to the table 2 by means of two knurled nuts 63 and 64, to be described presently.

The support unit formed by the table 2 which can also be called a ("first support") and the aforementioned second support 6 is mounted on a third support comprising a vertical shaft or column 14 and, a plate 15 pivoted about a horizontal shaft 16. This shaft is mounted on a base 17 removably fixed on the longitudinal slide 1*a*. The vertical shaft 14 is also fixedly mounted and rigidly held on base 17.

Figure 2:
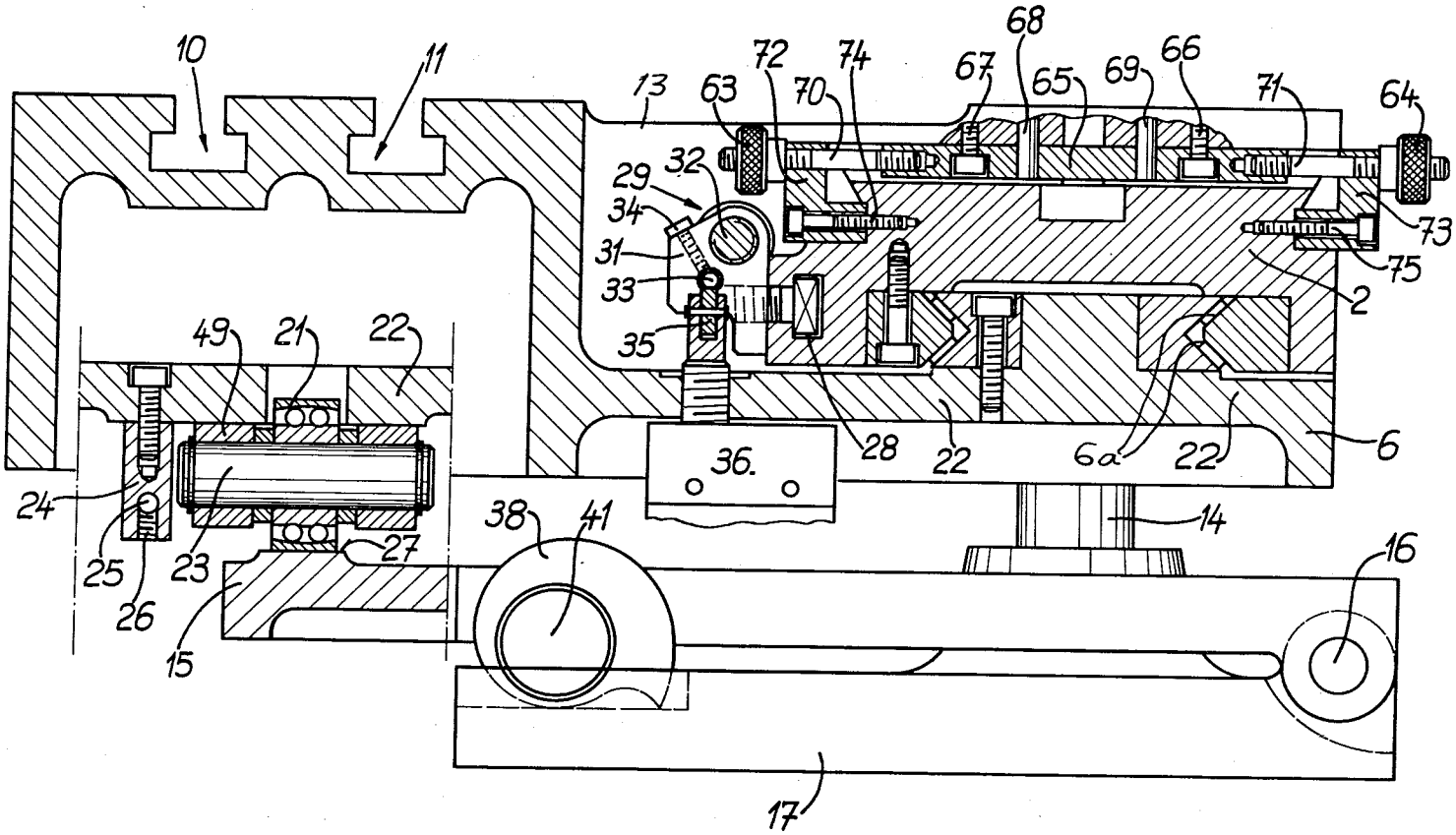
FIG. 2 is a cross-section along line II—II of FIG. 3, with a detail shown in cross-section along line II'—II'.

As shown in FIGS. 1 and 2, the headstock 4 is not directly fixed to the first support table 2, but is fixed by the intermediate of a packing-piece 65 fixed to the headstock by two screws 66 and 67 and two conical pins 68 and 69. The piece 65 is positioned by two pins 70 and 71 passing freely through two support brackets 72,73 each fixed to table 2 by a pair of screws 74,75 respectively, these brackets having vertical outer lateral faces against which the knurled nuts 63 and 64 screwed on pins 70 and 71 come to bear.

Figure 3:
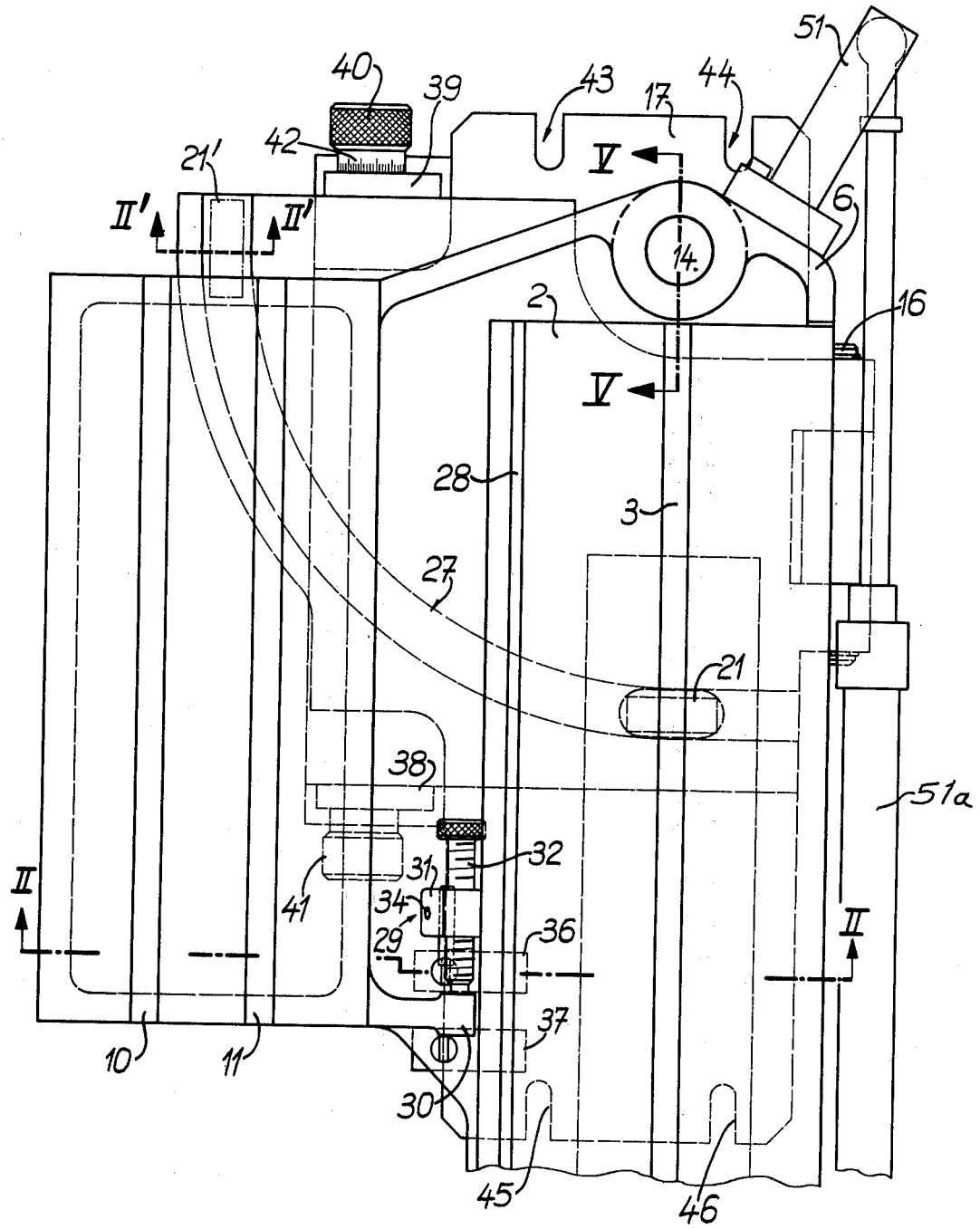
FIG. 3 is a top plan view of the machine, without the headstock or the device for helicoidally driving it.
Figure 4:
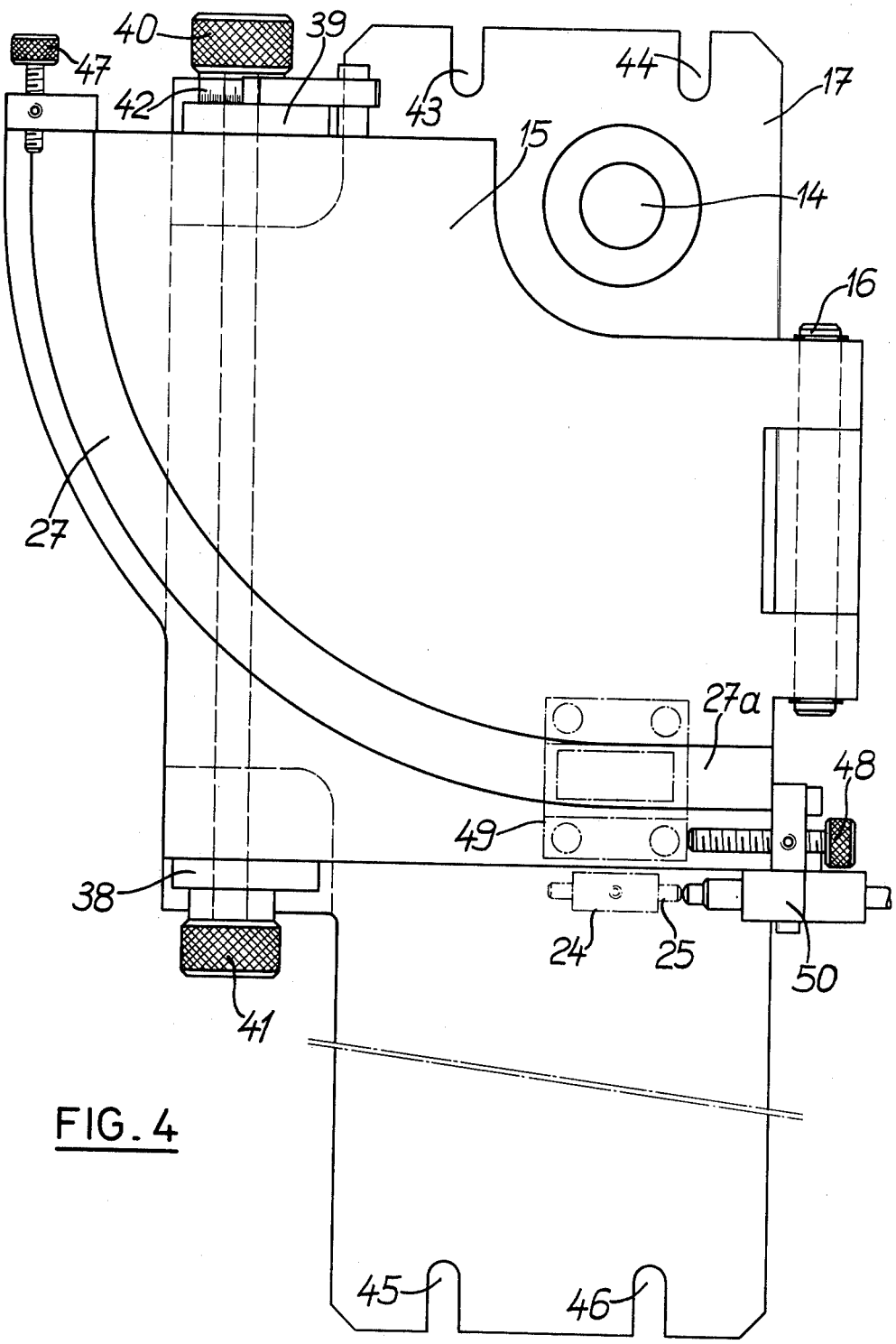
FIG. 4 is a plan view of a lower part of the machine.

The second support 6 is provided with a roller 21 (FIGS. 2 and 3) mounted on a ball bearing fixed in the horizontal plate 22 of support 6. The entire support unit comprising first support table 2 and second support 6 can be horizontally pivoted about vertical shaft 14 by 90° from the position shown in FIG. 3 to bring the roller to a position 21', the roller being shown in cross-section in this position in FIG. 2. Roller 21 is mounted on a shaft 23 supported by bearings 49 screwed under plate 22. To the left of shaft 23 (FIG. 2) is a cam carrier 24 in which is fixed a rod 25 whose position can be set longitudinally and locked by means of a screw 26. This rod 25 is arranged to actuate an end-of-path switch 50 (FIG. 4). The roller 21 is able to roll on an arcuate track 27 of plate 15, the track 27 forming a ramp when plate 15 is inclined.

The first support table 2 also carries on one longitudinal edge two abutments 29 the positions of which can be set along a longitudinal groove 28. One of these abutments 29 is shown in FIGS. 2 and 3. These abutments are identical and are situated on opposite sides of a fixed stop 30 integral with the second support 6. Each abutment 29 comprises a body 31 carrying on the one hand an adjustable abutment screw 32 mounted so that it also performs the function of a shock absorber and, on the other hand, a rod 33 similar to rod 25. Rod 33 can be locked by means of a screw 34. The rod 33 acts as a cam against a roller 35 of an end-of-path switch 36 fixed in the plate 22 of support 6. A second end-of-path switch 37 (FIG. 3) is actuated by the other abutment 29. These abutments and switches control starting and stopping of the device for helicoidally driving the headstock spindle 5, and their spacing corresponds to the length of the helix to be ground.

To the pivoted plate 15 are fixed cams 38 and 39 (FIGS. 1 to 4) mounted on a common horizontal shaft actuable by two knurled ends 40 and 41 by means of a micrometer screw including a graduated drum 42 which indicates the vertical displacement of the raised end of track 27. Cams 38 and 39 bear on the base plate 17 to raise the pivoted plate 15.

As shown in FIGS. 3 and 4, the base 17 is provided with four notches 43, 44, 45 and 46 for bolting this base and the elements of the machine supported thereby onto the longitudinal slide 1*a*.

FIG. 4 shows the lower or "third" support including pivoted plate 15 with its rolling track 27. This track has a principal arcuate part extending over 90° and terminates with a short rectilinear part 27*a* adjacent pivot 16. In use, practically only the arcuate part of the rolling track is employed. At the ends of track 27 are abutment screws 47 and 48 that can be set at a desired position. These screws cooperate with one of the bearings 49 of roller 21, shown in a chain line in this Figure as they belong to the support 6. Also shown in chain lines is the rod 25 which comes to actuate end-of-path switch 50. This switch 50 is used to control a jack 51*a*, shown at the right side of FIG. 3, extending parallel to the base 17, and whose piston is articulated to the end of an arm 51 secured to the support 6 by screws, for swinging support 6 about column or shaft 14 as indicated at 21, 21'. This jack is removed in FIG. 1.

Figure 5:
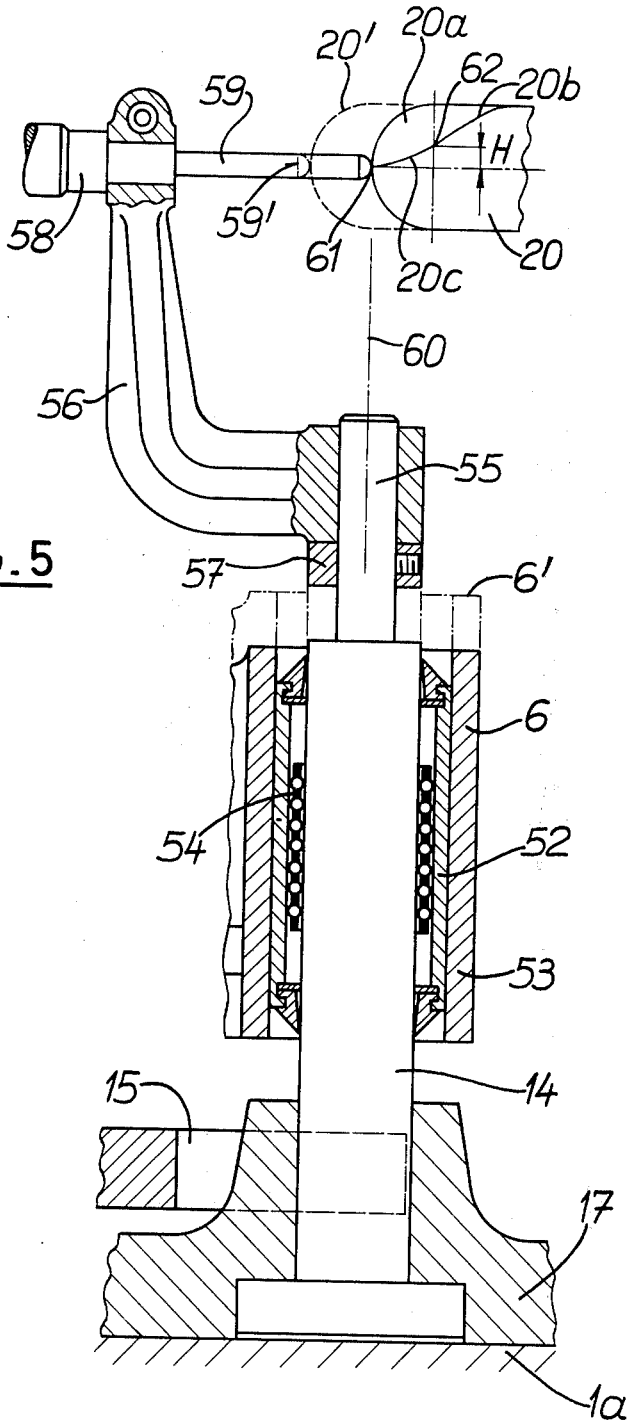
FIG. 5 is a cross-section along line V—V of FIG. 3, showing the mounting of the support unit for vertical movement and rotation about a vertical shaft.

FIG. 5 shows a detail of the mounting of the support 6 (and hence the support unit 2/6) on shaft 14. This mounting includes a ball bearing of the type available under the Trade Mark ROTOLIN, comprising an outer sleeve 52 fixed to a hub 53 of support 6, and in which is mounted a ball race 54 extending over only a part of the length of sleeve 52 so that the ball race 54 can move both in rotation and axially.

The support 6 (and hence support unit 2/6) can thus move both in rotation and vertically on the shaft 14. The extent of vertical displacement of the support 6 is indicated by its upper position 6' shown in chain lines. The upper part of shaft 14 is extended by a shaft 55 of reduced diameter on which is fixed a ring 57 supporting a pivotally mounted support arm 56. This support arm 56 carries a micrometer 58 having a protruding finger 59 by means of which the end of a workpiece 20 to be machined is brought into a very precise position in relation to the vertical axis of rotation 60, i.e. to the axis of shaft 14.

To machine a milling cutter by grinding a workpiece 20 having a hemispherical head 20*a*, firstly the end of the workpiece is brought, as shown in a full line in FIG. 5, onto the axis 60 by shifting the longitudinal slide 1*a*. Then the micrometer finger 59 is withdrawn by an amount equal to the radius of the hemispherical end 20*a*, to bring it to position 59', and the workpiece 20 is advanced until it reaches position 20' in abutment with finger 59'. In this position, the axis 60 passes through the centre of the hemisphere forming end 20*a*. Then, by means of the knurled nuts 63 and 64, the headstock 4 is slightly displaced in a direction transverse to the workpiece, on the table 2, in a manner to shift the vertical axis of the hemisphere from the axis 60 by a value that can easily be calculated trigonometrically and which, in practice, is read on a table as a function of the diameter of the hemisphere and the pitch of the helix 20*b* to be machined on the cylindrical part of workpiece 20. This shift is also obtained using the micrometer finger 59.

Then the plate 15 is lifted up by means of cams 38 and 39 by the desired amount corresponding to the difference of level between the end or pole 61 of the hemisphere and the point 62 at which the helix 20*b* is to begin. Then, by means of the jack 51*a* acting on arm 51 (FIG. 3), the support unit 2/6 is turned clockwise by 90° to bring roller 21 to position 21' against abutment 47 (FIG. 4). Then, a grinding wheel 76 (FIG. 6*a*), suitably flat or bevelled, according to the face of the cutting edge to be ground and suitably mounted on the grinding wheel carrier 1*c'*, is brought into contact with the end 61 of the workpiece 20 and grinding commences. The roller 21 of support 6 is allowed to roll down the track 27, i.e. the inclined plane of plate 15, at a relatively slow uniform speed, braking being provided by the jack. The support unit 2/6 consequently describes a helical path whose slope at the starting position 21' (FIG. 3) is zero and progressively increases to reach, at position 21 (FIG. 3), the slope of helix 20*b*. The corresponding helix of progressive slope produced by wheel 76 is shown on the workpiece 20 by 20*c*. When the support 6 arrives against abutment 48, is actuates the switch 50 which controls the starting of the helicoidal drive device of workpiece spindle 5. The joint between the parts 20*c* and 20*b* of the cutting edge is thus perfectly machined in a progressive uniform manner.

Advance of the spindle 5 may be provided by a jack instead of by a reducing motor as described in U.S. Pat. No. 3,851,563. Such a jack would directly push a sliding carriage carrying a roller fixed on a toothed belt of the upper element of the device, the belt driving a pinion which in turn rotates the spindle, pushing of the jack providing an advance of the table 2 in the same manner as in U.S. Pat. No. 3,851,563. Grinding of the helicoidal edge of the milling cutter thus takes place continuously from the rounded head of the workpiece towards its rear end until an abutment 29 of the table (FIGS. 2,3) comes to abut the stop 30 and actuates the end-of-path switch.

Figure 6A:
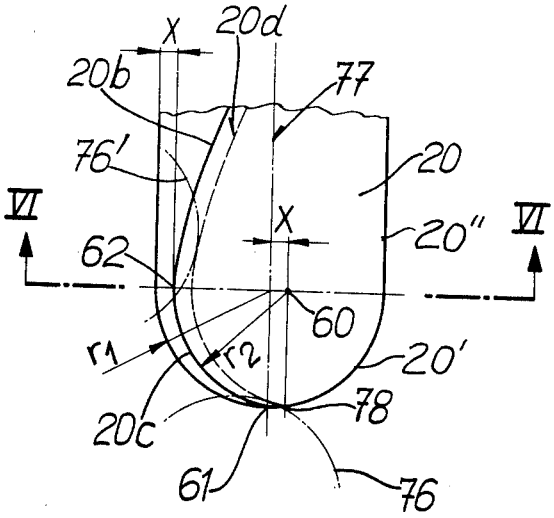
FIGS. 6*a* and 6*b* schematically show the positions of a workpiece to be ground, a grinding wheel and the axes of the machine during machining.
Figure 6B:
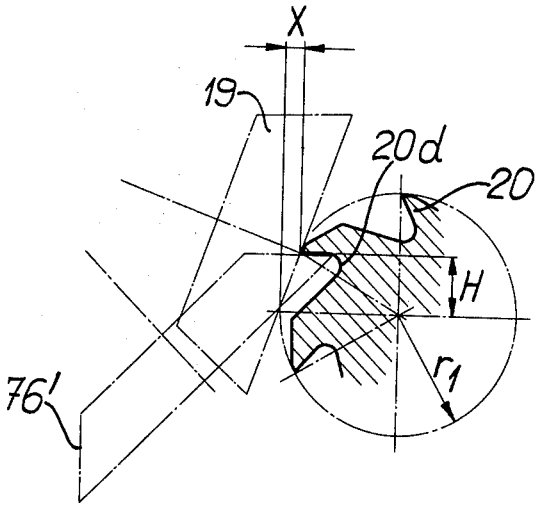

FIGS. 6*a* and 6*b* schematically illustrate the grinding process. FIG. 6*a* is a plan view and FIG. 6*b* a cross-section along line VI—VI of FIG. 6*a*. FIG. 6*a* shows the workpiece 20 and the grinding wheel 76 used to grind the cutting edge into the rounded head surface 20' in the starting position, and into the smoothly continuing, cylindrical shank surface 20'' in a position 76' after rotation of the workpiece by 90° about axis 60. FIG. 6*b* also shows the grinding wheel 19 used to back-off the cutting edge. It can be seen that the centre of the hemisphere, i.e. the workpiece axis 77 has been shifted by a distance X in relation to the vertical axis 60. This distance X can be easily calculated trigonometrically from the radius $r_1$ of the hemisphere and the corresponding height H of the vertical displacement of the workpiece. The distance X is equal to the distance by which a helix of height H, starting from the pole 61 of the hemisphere, would move away from the hemispherical surface. Hence, one starts from a point 78 situated at a distance X from the pole 61 and describes a circular arc of radius $r_2$ about the axis 60. The radius $r_2$ is in principle equal to $r_1$ but it may be different in order to introduce a supplementary correction. The bottom of the edge 20*b*/20*c* is shown at 20*d*.

Operation will be similar when the centre of the radius of the rounded end of the workpiece is not the centre of a sphere but is on a circle, as is the case when only the edge of the end of the workpiece is round.

The same procedure will be followed if, instead of using an inclined plane (i.e. plate 15) by which a helix of progressive slope is obtained, one uses a screw or a helical ramp of constant slope.

In addition to the previously mentioned advantages, notably that of having a helical cutting edge from the round end of the machined tool, it is observed that, in view of the backing-off angle of the edge, during the displacement H, with the grinding wheel at a constant angle, the cutting angle increases from point 61 to point 62.

In another embodiment (not shown) the "third" support, on which the support unit is mounted, is formed by a vertical column having a helicoidal shoulder or groove cooperating with a helicoidal shoulder or groove of the first support.

According to a more sophisticated embodiment, it is possible to impart to the planar or helicoidal ramp, a vertical movement, up or down, during rotation of the support unit 2/6, with a suitable kinematic coupling, for example by means of a rack and pinions, the vertical movement of the ramp being transmitted to the grinding tool. By changing the ratio of the pinions, the speed of raising and lowering of the ramp could be modified.

According to another embodiment, not shown, the machine comprises at least one horizontal slide on which a grinding or milling tool carrier is mounted. A support unit consisting of slidably mounted first and second supports is rotatably mounted on the machine about a vertical axis, but fixed against vertical movement. A plate is pivotally mounted on the support unit about a horizontal axis and carries a ramp extending in circular configuration about said vertical axis. The tool carrier is mounted on a column by means of a slide able to slide in a vertical plane and provided with a prop arranged to be supported on said ramp so that when the support unit is rotated about the vertical axis the prop is moved vertically and drives the tool carrier, the relative movement of the tool and support unit being helicoidal. The helix described during this relative movement has a variable or fixed pitch according to whether the prop moves on a plane inclined to the vertical axis or on a helicoidal ramp of constant slope.

The machine according to the invention can be used to machine various cutting tools, in addition to milling cutters.

What is claimed is:

1. A machine for machining a spiral cutting edge on a workpiece having an elongate shank with a rounded head, comprising;

a support unit comprising first and second supports mounted for sliding movement relative to one another and for joint rotation about a vertical axis;

a headstock carried by the first support, the headstock having a spindle for carrying thereon and, coaxially with an axis thereof, a workpiece having a rounded head surface and a cylindrical shank surface smoothly continuing the head surface, the headstock being positionable so that in one position of the headstock, the axis of the spindle intersects the vertical axis;

a device mounted on the second support for helicoidally driving the headstock spindle;

a rotary machining tool;

means for mounting the support unit for vertically translational and horizontally rotational movements thereof, the latter being centered about the vertical axis; and means for simultaneously effecting the vertically translational and the horizontally rotational movements to provide a helicoidal movement of the support unit relative to the machining tool;

whereby the machining tool can machine a spiral cutting edge on the workpiece extending over the rounded head surface and smoothly continuing over the cylindrical shank surface of the workpiece, to produce a round-headed machined tool.

2. A machine for machining a spiral cutting edge on a workpiece having an elongate shank with a rounded head surface, comprising;

a support unit comprising first and second supports mounted for sliding movement relative to one another and for joint rotation;

a headstock carried by the first support, the headstock having a spindle for carrying thereon and, coaxially with an axis thereof, a workpiece having a rounded head surface and a cylindrical shank surface smoothly continuing the head surface, the headstock being positionable so that in one position of the headstock, the axis of the spindle intersects a vertical axis;

a device mounted on the second support for helicoidally driving the headstock spindle;

a rotary machining tool unit;

means for mounting at least one of the units for vertical translational and horizontal rotational movements relative to one another and for centering the latter movement about the vertical axis; and means for simultaneously imparting to one of the units, relative to the other, the vertical translational and horizontal rotational movements to provide a helicoidal relative movement of the support unit and the machining unit tool, whereby the machining tool unit can machine a spiral cutting edge on the workpiece extending over the rounded head surface and smoothly continuing over the cylindrical shank surface to produce a round-headed machined tool.

3. A machine according to claim 2, in which the first support is a table, and which also includes means for effecting and guiding movements of the headstock, on and parallel to the first support table, in a direction parallel to the headstock spindle and also in a direction perpendicular to the headstock spindle, to adjust the rounded head surface of the workpiece relative to the rotary machining tool unit.

4. A machine according to claim 2 in which the means for mounting has the support unit mounted on it for the vertical translational and horizontal rotational movements thereof, and a third support including a ramp extending about the vertical axis, and means for guiding the support unit along the ramp.

5. A machine according to claim 4, in which the third support comprises, a base carrying a fixed vertical shaft to define the vertical axis, and a plate extending about the vertical shaft and pivotally mounted on the base about a horizontal axis for pivotal inclining of the plate to provide the ramp and to dispose it helicoidally about the vertical shaft.

6. A machine according to claim 5, in which the ramp is a track on the plate, extending over a quarter of a circle and centered approximately about the vertical shaft when the plate is substantially horizontal; the means for guiding the support unit comprising a roller mounted on said unit and engaging the track.

7. A machine according to claim 5, comprising cam means mounted between the plate and the base for setting the inclining of the plate.

* * * * *